US010221729B2

(12) United States Patent
Ahmed et al.

(10) Patent No.: US 10,221,729 B2
(45) Date of Patent: Mar. 5, 2019

(54) ROCKER SHAFT WITH DE-AERATION OIL GALLERY SEGMENT

(71) Applicant: Schaeffler Technologies AG & Co. KG, Herzogenaurach (DE)

(72) Inventors: Faheem Ahmed, Troy, MI (US); Colin Foster, Belle River (CA); David Chandler, Windsor (CA); John Whitton, Milwaukee, WI (US); Debora Manther, Royal Oak, MI (US); Pradeep Mohan Mohan Das, Troy, MI (US); Sumukha Nagaraj, Dearborn, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 77 days.

(21) Appl. No.: 15/624,365

(22) Filed: Jun. 15, 2017

(65) Prior Publication Data

US 2017/0284236 A1 Oct. 5, 2017

Related U.S. Application Data

(63) Continuation-in-part of application No. 15/217,325, filed on Jul. 22, 2016, now Pat. No. 9,945,270.
(Continued)

(51) Int. Cl.
*F01M 9/10* (2006.01)
*F01L 1/24* (2006.01)
(Continued)

(52) U.S. Cl.
CPC ..... *F01L 1/24* (2013.01); *F01L 1/053* (2013.01); *F01L 1/18* (2013.01); *F01L 1/181* (2013.01);
(Continued)

(58) Field of Classification Search
CPC ..... F01L 1/181; F01L 1/2416; F01L 1/46; F01M 9/105; F01M 9/107; F02F 7/0068
(Continued)

(56) References Cited

U.S. PATENT DOCUMENTS 5,125,373 A * 6/1992 Yamada ..... F01L 1/18 123/196 M
5,592,907 A 1/1997 Hasebe et al.
(Continued)

OTHER PUBLICATIONS

U.S. Appl. No. 15/175,654, filed Jun. 7, 2016. (Unpublished).

*Primary Examiner* — Jorge Leon, Jr.
(74) *Attorney, Agent, or Firm* — Volpe and Koenig, P.C.

(57) ABSTRACT

A switchable valve train assembly including a carrier housing defining a hydraulic circuit, a supply assembly, a plurality of rocker shafts, a plurality of separators, and a plurality of rocker arm assemblies is provided. Each one of the plurality of separators divides the rocker shafts into (1) a first chamber extending between a first chamber axial end and the separator, and (2) a second chamber extending between a second chamber axial end and the separator. The plurality of separators each include an orifice defined between the first chamber and the second chamber that provides fluid connection between the first chamber and the second chamber. Locking assemblies of the rocker arm assemblies are selectively actuated based on the supply assembly. The separators ensure that hydraulic fluid within the hydraulic fluid is de-aerated and that the second chambers remain primed with hydraulic fluid for faster actuation of the locking assemblies.

9 Claims, 7 Drawing Sheets

Related U.S. Application Data

(60) Provisional application No. 62/195,835, filed on Jul. 23, 2015.

(51) Int. Cl.

| | |
|---|---|
| ***F01L 1/18*** | (2006.01) |
| ***F01L 1/053*** | (2006.01) |
| ***F01L 13/00*** | (2006.01) |
| *F01L 1/46* | (2006.01) |
| *F02F 7/00* | (2006.01) |

(52) U.S. Cl.

CPC ..... *F01L 13/0005* (2013.01); *F01L 1/2416* (2013.01); *F01L 1/46* (2013.01); *F01L 2001/186* (2013.01); *F01L 2013/001* (2013.01); *F01L 2105/00* (2013.01); *F01M 9/105* (2013.01); *F01M 9/107* (2013.01); *F02F 7/0068* (2013.01)

(58) Field of Classification Search

USPC ..... 123/90.36, 90.38, 90.46

See application file for complete search history.

(56) References Cited

U.S. PATENT DOCUMENTS

| | | | | |
|---|---|---|---|---|
| 6,584,942 | B1 | 7/2003 | Albertson et al. | |
| 6,584,951 | B1 | 7/2003 | Patel et al. | |
| 6,598,578 | B2 | 7/2003 | Takahashi et al. | |
| 6,684,836 | B2 | 2/2004 | Inoue | |
| 6,810,846 | B2 * | 11/2004 | Murata | F01L 1/267 123/196 M |
| 2008/0178828 | A1 | 7/2008 | Patel et al. | |
| 2008/0302322 | A1 | 12/2008 | Edelmayer et al. | |
| 2010/0170472 | A1 * | 7/2010 | Yang | F01L 1/08 123/321 |

* cited by examiner

ROCKER SHAFT WITH DE-AERATION OIL GALLERY SEGMENT

INCORPORATION BY REFERENCE

The following document is incorporated herein by reference as if fully set forth: U.S. Provisional Patent Application No. 62/195,835, filed Jul. 23, 2015; and U.S. patent application Ser. No. 15/217,325, filed Jul. 22, 2016.

FIELD OF INVENTION

The present invention relates to a switchable valve train, and more particularly relates to a rocker shaft for a switchable valve train.

BACKGROUND

Multiple types of switchable valve train systems including rocker arms arranged on rocker shafts are known. One type of switchable valve train system includes rocker arms with a hydraulic lash adjuster and a locking assembly arranged on opposite sides of the rocker arm. One type of known rocker shaft includes a hollow center for directing hydraulic fluid from a feed port to the hydraulic lash adjuster and the locking assembly of an associated rocker arm.

One known arrangement of a switchable valve train is shown in FIG. 1, which is from U.S. Pub. 2008/0302322. As shown in FIG. 1, the switchable valve train assembly 100 includes a rocker shaft 101 having a plurality of intake ports 102. A plurality of switchable rocker arm assemblies 110 are provided along the rocker shaft 101 that include a camshaft end 106 and a valve end 108. The rocker shaft 101 includes a hollow center 104 for directing hydraulic fluid from a hydraulic fluid supply assembly (not shown) to the associated switchable rocker arm assemblies 110. The switchable rocker arm assemblies 110 are selectively controlled to actuate a locking assembly and to supply pressurized hydraulic fluid to the lash adjuster (not shown) associated with each switchable rocker arm assembly 110 based on a supply of hydraulic fluid from the hollow center 104 of the rocker shaft 101. The flow of hydraulic fluid through the rocker shaft 101 can create air bubbles or pockets, which causes hydraulic fluid flow fluctuations and disrupts performance of the rocker arm assemblies. The switchable valve train assembly 100 also includes two standard rocker arms 105 outside of the switchable rocker arm assemblies 110.

It would be desirable to provide a rocker shaft that offers a reliable, continuous flow of de-aerated hydraulic fluid from the hydraulic fluid supply assembly to the locking assembly of the rocker arm assembly.

SUMMARY

A switchable valve train assembly including a rocker shaft with an improved internal chamber configuration that reduces air pockets and air bubbles is provided. The switchable valve train assembly includes a supply assembly including a pressurized fluid source for pressurized hydraulic fluid, and a solenoid and a control valve for selectively supplying the hydraulic fluid. A hydraulic lash adjuster feed channel is in fluid connection with the pressurized fluid source, and a switch channel is in fluid connection with the control valve. A hollow rocker shaft includes a central opening defined by a radially inner surface, and a separator is secured in the central opening of the rocker shaft by a radially outer surface of the separator engaging the radially inner surface of the rocker shaft. The separator divides the central opening of the rocker shaft into a (1) first chamber extending between a first chamber axial end and the separator, and (2) a second chamber extending between a second chamber axial end and the separator. The separator includes an orifice defined between the first chamber and the second chamber providing fluid connection between the first chamber and the second chamber. A first chamber end cap is fixed in the rocker shaft and defines the first chamber axial end, and a second chamber end cap is fixed in the rocker shaft and defines the second chamber axial end. The hydraulic lash adjuster feed channel is in fluid communication with the first chamber, and the switch channel is in fluid communication with the second chamber. A rocker arm assembly is arranged on the rocker shaft and includes a hydraulic lash adjuster connected to a first intake port and a locking assembly connected to a second intake port. The first chamber includes a first actuator port in fluid connection with the first intake port for the hydraulic lash adjuster, and the second chamber includes a second actuator port in fluid connection with the second intake port for the locking assembly.

The orifice of the separator provides fluid connection between the first chamber and the second chamber and ensures a continuous flow of hydraulic fluid which helps reduce air pockets and air bubbles in the hydraulic fluid in the second chamber.

In one embodiment, the separator includes a first recess on the radially outer surface that defines a first passage between the first chamber and the first actuator port, and a second recess on the radially outer surface that defines a second passage between the second chamber and the second actuator port.

In another embodiment, more than one separator is provided within the rocker shaft.

In another embodiment, a switchable valve train assembly including a carrier housing defining a hydraulic circuit, a supply assembly, a plurality of rocker shafts, a plurality of separators, and a plurality of rocker arm assemblies is provided. Each one of the plurality of separators divides the rocker shafts into (1) a first chamber extending between a first chamber axial end and the separator, and (2) a second chamber extending between a second chamber axial end and the separator. The plurality of separators each include an orifice defined between the first chamber and the second chamber that provides fluid connection between the first chamber and the second chamber. Locking assemblies of the rocker arm assemblies are selectively actuated based on the supply assembly. The separators ensure that hydraulic fluid within the hydraulic fluid is de-aerated and that the second chambers remain primed with hydraulic fluid for faster actuation of the locking assemblies.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
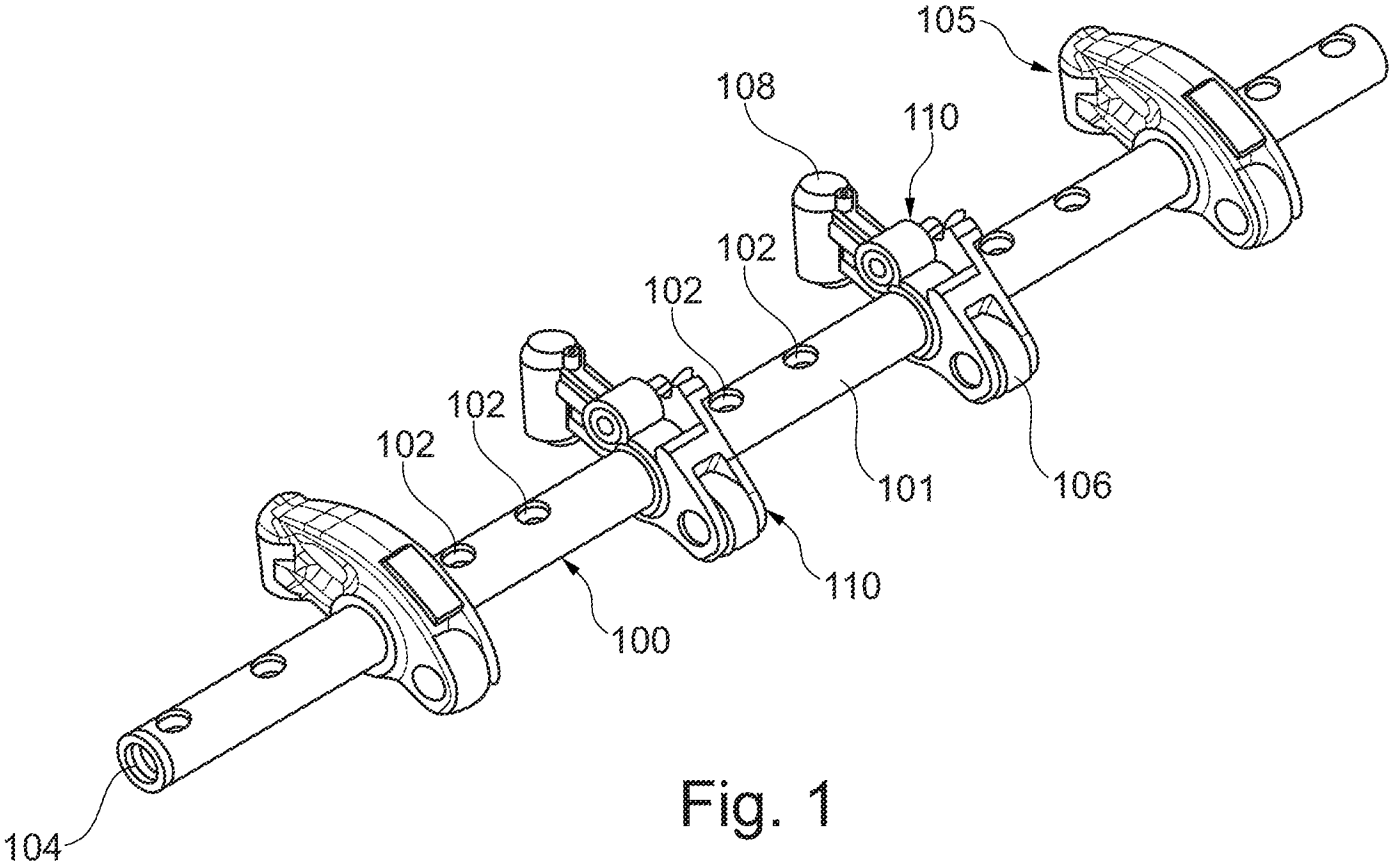
Fig. 1 ( PRIOR ART)
FIG. 1 is a perspective view of a rocker shaft according to the prior art.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Figure 2:
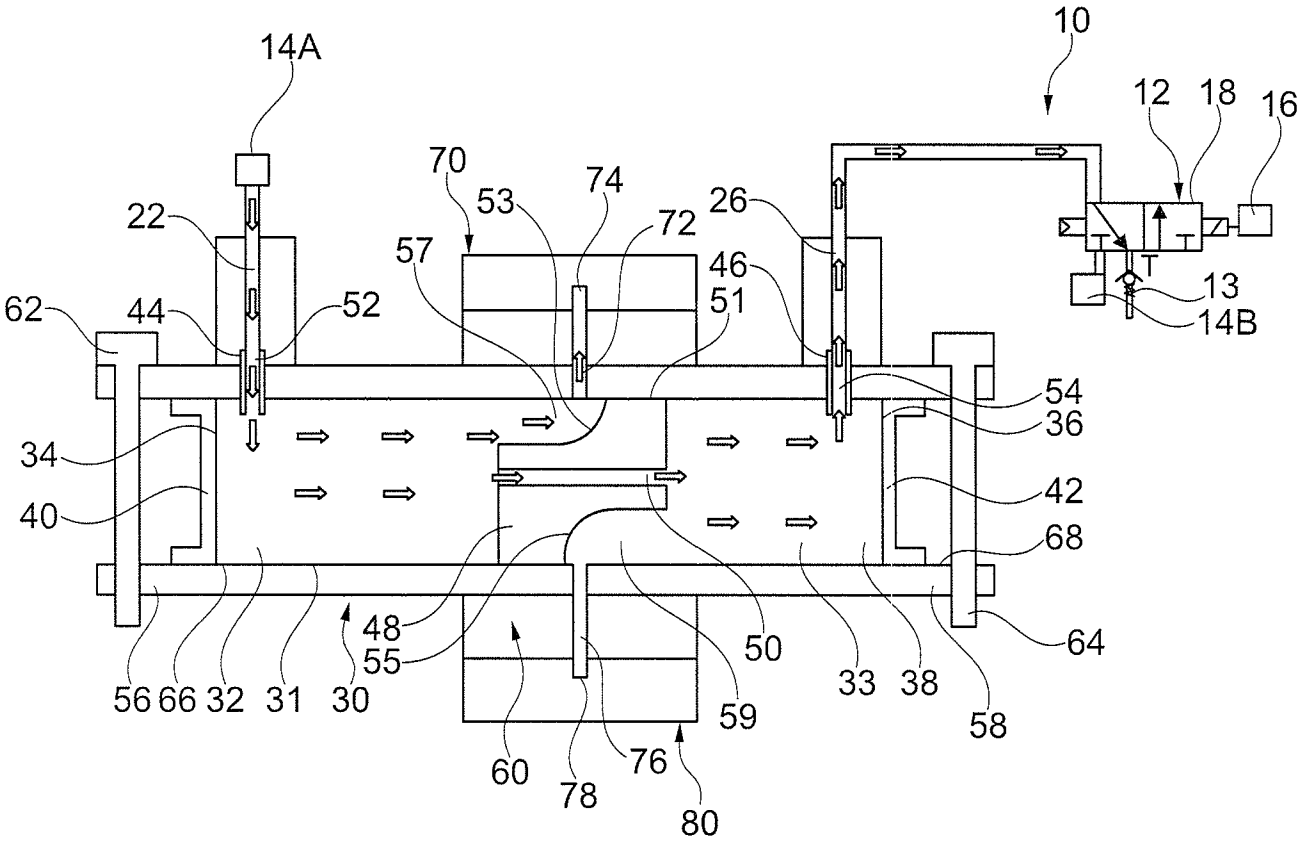
FIG. 2 is a schematic sectional view of a switchable valve train assembly according to an embodiment of the disclosure in a non-actuated state.
Figure 3:
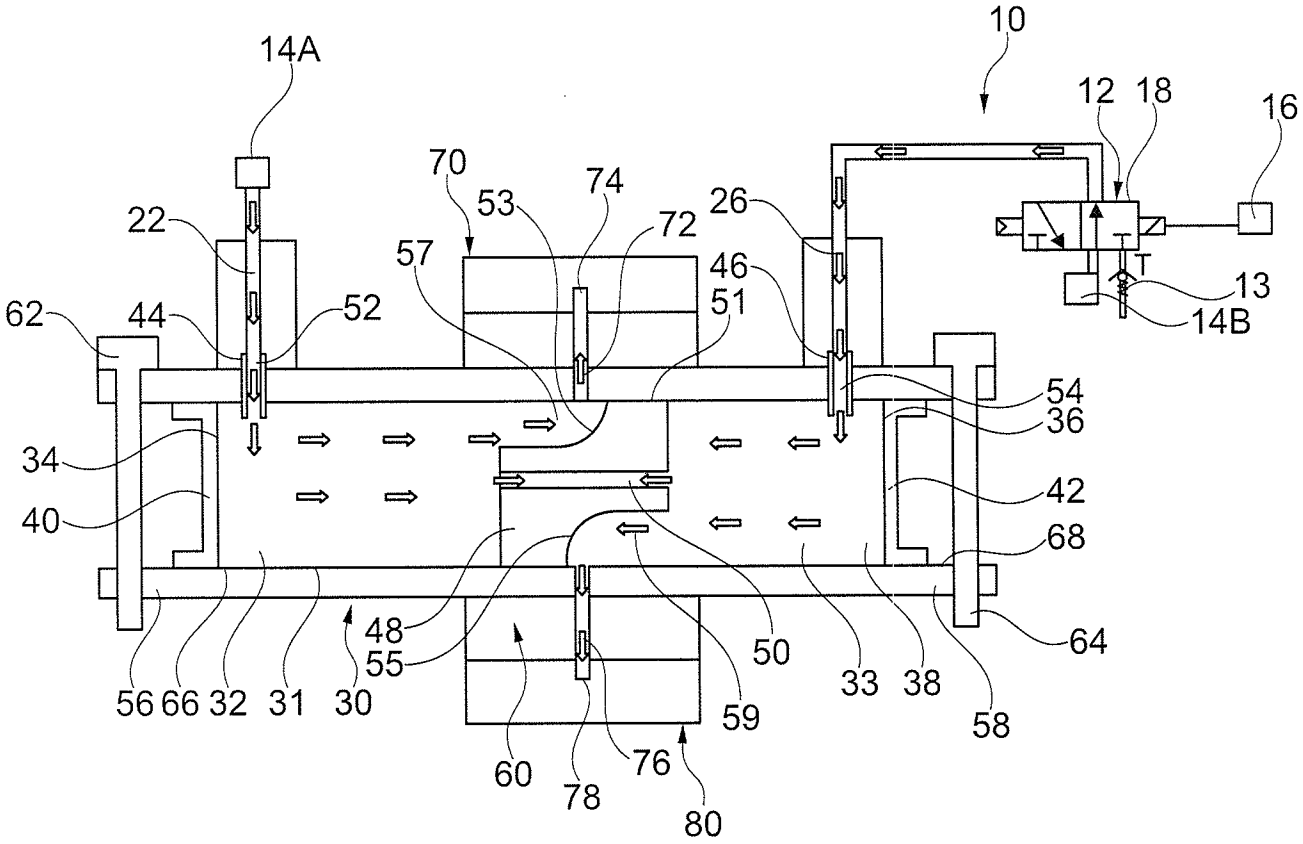
FIG. 3 is a schematic sectional view of the switchable valve train assembly of FIG. 2 in an actuated state.

Referring to FIGS. 2 and 3, a switchable valve train assembly 10 including a supply assembly 12 and a hollow rocker shaft 30 is provided. The supply assembly 12 includes a pressurized fluid source 14A, 14B for pressurized hydraulic fluid, and a solenoid 16 and a control valve 18 for selectively supplying the pressurized hydraulic fluid. A hydraulic lash adjuster feed channel 22 is in fluid connection with the pressurized fluid source 14A, and a switch channel 26 is in fluid connection with the pressurized fluid source 14B or a tank connection (T) via a check valve 13, depending on the position of the control valve 18. The pressurized fluid source 14A, 14B are schematically illustrated as two separate sources in FIGS. 2 and 3, however the pressurized fluid sources 14A, 14B for each of the hydraulic lash adjuster feed channel 22 and the switch channel 26 are provided within the same hydraulic fluid circuit.

The rocker shaft 30 includes a central opening 33 defined by a radially inner surface 31. The rocker shaft 30 can be formed from steel, aluminum, or any other suitable material. A separator 48 is secured in the central opening 33 of the rocker shaft 30 and a radially outer surface 51 of the separator 48 engages the radially inner surface 31 of the rocker shaft 30. In one embodiment, the separator 48 is press-fit within the rocker shaft 30. The separator 48 divides the central opening 33 of the rocker shaft 30 into (1) a first chamber 32 extending between a first chamber axial end 34 of the rocker shaft 30 and the separator 48, and (2) a second chamber 38 extending between a second chamber axial end 36 of the rocker shaft 30 and the separator 48. The separator 48 includes an orifice 50 defined between the first chamber 32 and the second chamber 38 providing fluid connection between the first chamber 32 and the second chamber 38. The separator 48 can be formed from plastic, metal, or any other suitable material. One of ordinary skill in the art would recognize from the present disclosure that the shape of the separator 48 can be varied. Any shape or configuration of the separator 48 can be used as long as the separator 48 provides three main functions: (1) dividing the rocker shaft 30 into the first chamber 32 and the second chamber 38; (2) directing pressurized hydraulic fluid out of the first chamber 32 and the second chamber 38 and towards a rocker arm assembly 60; and (3) providing fluid connection between the first chamber 32 and the second chamber 38, i.e. via the orifice 50.

A first chamber end cap 40 fixed in the rocker shaft 30 defines the first chamber axial end 34, and a second chamber end cap 42 fixed in the rocker shaft 30 defines the second chamber axial end 36. The hydraulic lash adjuster feed channel 22 is in fluid communication with the first chamber 32 and the switch channel 26 is in fluid communication with the second chamber 38. The orifice 50 reduces air pockets and air bubbles in the second chamber 38 in order to improve the function of the switchable valve train assembly 10. The orifice 50 ensures that the second chamber 38 is always filled with hydraulic fluid and immediately available for a switching operation which reduces switching times of the switchable valve train assembly 10.

A first tube 44 extends between the hydraulic lash adjuster feed channel 22 and the first chamber 32. A second tube 46 extends between the switch channel 26 and the second chamber 38. One of ordinary skill in the art would recognize from the present disclosure that alternative channeling arrangements could be used to direct pressurized hydraulic fluid from the supply assembly 12 to the rocker shaft 30 which do not include separately formed sleeves 44, 46.

The rocker arm assembly 60 is arranged on the rocker shaft 30 and includes a hydraulic lash adjuster 70 connected to a first intake port 74 and a locking assembly 80 connected to a second intake port 78. The first chamber 32 includes a first actuator port 72 in fluid connection with the first intake port 74 for the hydraulic lash adjuster 70, and the second chamber 38 includes a second actuator port 76 in fluid connection with the second intake port 78 for the locking assembly 80. The hydraulic lash adjuster 70 and the locking assembly 80 are selectively operated based on the supply of pressurized hydraulic fluid from the supply assembly 12. In one embodiment, the separator 48 includes a first recess 53 on the radially outer surface 51 that defines a first passage 57 between the first chamber 32 and the first actuator port 72, and the separator 48 includes a second recess 55 on the radially outer surface 51 that defines a second passage 59 between the second chamber 38 and the second actuator port 76. As shown in FIGS. 2 and 3, the first recess 53 and the second recess 55 of the separator 48 overlap in a plane extending in a radial direction. Alternatively, the separator could be formed by an angled plate set at an angle to the shaft axis so that no recesses are needed.

In one embodiment, the rocker shaft 30 includes a first axially extending flange 56 at the first chamber axial end 34 and a second axially extending flange 58 at the second chamber axial end 36. A first bolt 62 radially extends through the first axially extending flange 56 and a second bolt 64 radially extends through the second axially extending flange 58. In one embodiment, the first chamber end cap 40 is fixed to the first chamber axial end 34 of the rocker shaft 30 via a press-fit against a radially inner surface 66 of the first axially extending flange 56. The second chamber end cap 42 is also fixed to the second chamber axial end 36 of the rocker shaft 30 via a press-fit against a radially inner surface 68 of the second axially extending flange 58. One of ordinary skill in the art would recognize from the present disclosure that alternative configurations of the end portions of the rocker shaft 30 may be used.

As shown in FIG. 2, the supply assembly 12 is in a non-actuated state for the locking assembly 80 of the rocker arm assembly 60 in which the solenoid 16 is in a first position and the control valve 18 of the supply assembly 12 directed to the switch channel 26 is closed, and the switch channel 26 is connected to the tank connection (T) via the check valve 13. In the non-actuated state, the orifice 50 directs pressurized hydraulic fluid from the first chamber 32 to the second chamber 38, as shown by the arrows in the orifice 50 in FIG. 2 where it can flow back through the switch channel 26 at a pressure set by the check valve 13, which is lower than the locking assembly 80 activation pressure, to the tank (T). This residual hydraulic fluid through the second chamber 38 purges the second chamber 38 of air pockets and air bubbles, and helps keep the second chamber 38 filled with hydraulic fluid for optimal switching times of the switchable valve train assembly 10.

As shown in FIG. 3, the supply assembly 12 is in an actuated state in which the solenoid 16 is in the second, switching state and the control valve 18 of the supply assembly 12 is connected to switching channel 26. In the actuated switching state, pressurized hydraulic fluid is provided to the locking assembly 80 via the second chamber 38, to unlock or deactivate a particular rocker arm. In one embodiment, the first mode of FIG. 2 corresponds to a locked mode in which the rocker arm assembly 60 is locked so that the associated valves of the switchable valve train assembly 10 are opened and closed for active cylinders. In this embodiment, the second mode of FIG. 3 corresponds to an unlocked mode in which the switchable rocker arm assembly 60 is unlocked and therefore the valves of the switchable valve train assembly 10 remain closed, which is used in connection with deactivating certain cylinders. One of ordinary skill in the art would recognize from the present disclosure that the first mode of FIG. 2 could correspond to an unlocked mode, and the second mode of FIG. 3 could correspond to a locked mode. One of ordinary skill in the art would also recognize from the present disclosure that the present arrangement could be used in connection with a cam profile switching strategy.

FIGS. 2 and 3 illustrate a shortened representation of a typical rocker shaft 30 with a single rocker arm 60. Those skilled in the art will recognize that a plurality of rocker arm assemblies 60, such as shown in FIG. 1, would typically be present on the rocker arm shaft, and only a single rocker arm assembly 60 has been illustrated in FIGS. 2 and 3 for the sake of clarity. Additionally, a plurality of separators 48, supply assemblies 12, pressurized fluid sources 14A, 14B, and the associated features and components of these elements could be provided within a single hollow rocker shaft 30. A single rocker shaft including multiple separators is discussed below with respect to FIGS. 4 and 5.

Figure 4:
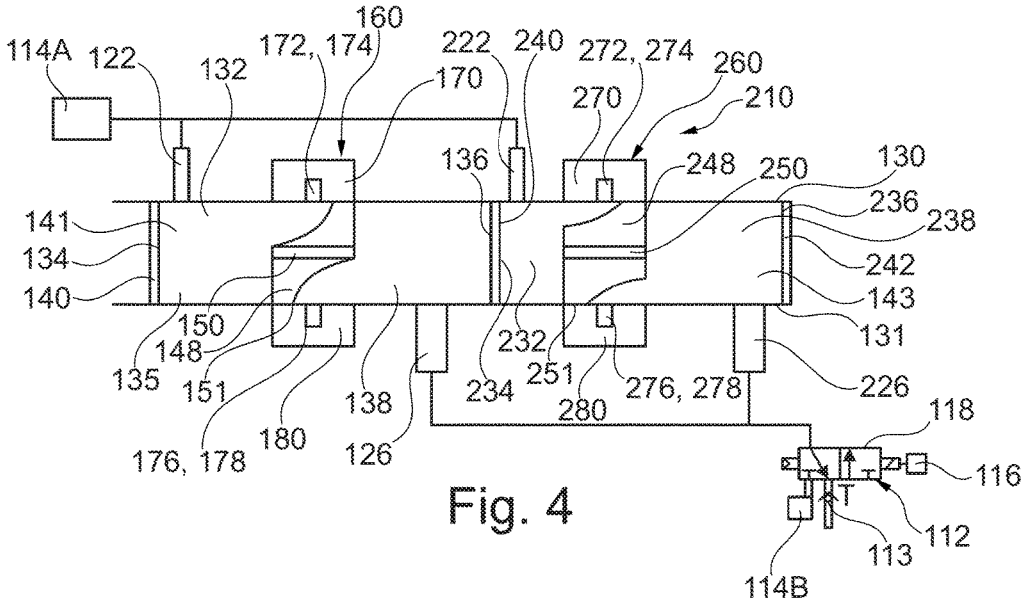
FIG. 4 is a schematic sectional view of a switchable valve train assembly including two separators.

Referring to FIG. 4, another embodiment of the switchable valve train assembly 210 is illustrated. In this embodiment, the rocker shaft 130 includes a central space 135 that is divided by an intermediate divider 240. A supply assembly 114A, 114B includes a pressurized fluid source for pressurized hydraulic fluid, and a solenoid 116 and a control valve 118 selectively supply the pressurized hydraulic fluid. Hydraulic lash adjuster feed channels 122, 222 are in fluid connection with the pressurized fluid source, and first and second switch channels 126, 226 are in fluid connection with the control valve 118. The central space 135 of the hollow rocker shaft 130 is defined by a radially inner surface 131. The intermediate divider 240 defines a first chamber 141 and a second chamber 143 in the central space 135. First and second separators 148, 248 are secured in a respective one of the first chamber 141 and the second chamber 143, and a radially outer surface 151, 251 of the first separator 148 and the second separator 248 engages the radially inner surface 131 of the rocker shaft 130. The first separator and the second separator 148, 248 each divide the first chamber 141 and the second chamber 143 into (1) a first sub-chamber 132, 232 extending between a first sub-chamber axial end 134, 234 and the respective separator 148, 248, and (2) a second sub-chamber 138, 238 extending between a second sub-chamber axial end 136, 236 and the respective separator 148, 248. The first separator 148 and the second separator 248 each include an orifice 150, 250 defined between the first sub-chamber 132, 232 and the second sub-chamber 138, 238 providing fluid connection between the first sub-chamber 132, 232 and the second sub-chamber 138, 238. A first sub-chamber end cap 140 is fixed in the rocker shaft 130 to define the first sub-chamber axial end 134, and a second sub-chamber end cap 242 is fixed in the rocker shaft 130 to define the second sub-chamber axial end 236. Each of the hydraulic lash adjuster feed channels 122, 222 are in fluid communication with a respective one of the first sub-chambers 132, 232, and each of the switch channels 126, 226 are in fluid communication with a respective one of the second sub-chambers 138, 238. First and second rocker arm assemblies 160, 260 are arranged on the rocker shaft 130 and each include a hydraulic lash adjuster 170, 270 connected to a first intake port 174, 274 and a locking assembly 180, 280 connected to a second intake port 178, 278. The first sub-chambers 132, 232 each include a first actuator port 172, 272 in fluid connection with the first intake port 174, 274 for the hydraulic lash adjuster 170, 270, and the second sub-chambers 138, 238 each include a second actuator port 176, 276 in fluid connection with the second intake port 178, 278 for the locking assembly 180, 280.

Figure 5:
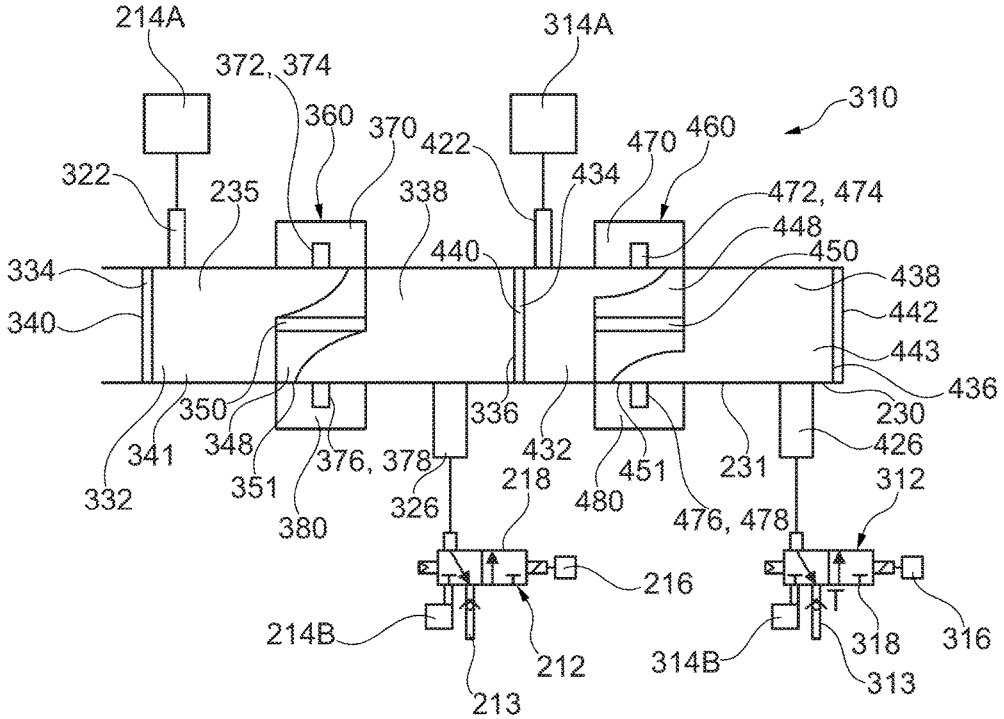
FIG. 5 is a schematic sectional view of a switchable valve train assembly including two separators and two supply assemblies.

Referring to FIG. 5, another embodiment of the switchable valve train assembly 310 is illustrated. This embodiment is similar to the embodiment illustrated in FIG. 4, except multiple supply assemblies and control valves are provided. First and second supply assemblies 214A, 214B, 314A, 314B each include a pressurized fluid source for pressurized hydraulic fluid, and a solenoid 216, 316 and a control valve 218, 318 for selectively supplying the pressurized hydraulic fluid. First and second hydraulic lash adjuster feed channels 322, 422 are in fluid connection with a respective pressurized fluid source. First and second switch channels 326, 426 are in fluid connection with a respective control valve 218, 318. The hollow rocker shaft 230 includes a central space 235 defined by a radially inner surface 231. An intermediate divider 440 defines a first chamber 341 and a second chamber 443 in the central space 235. First and second separators 348, 448 are secured in a respective one of the first chamber 341 and the second chamber 443, and a radially outer surface 351, 451 of the first separator 348 and the second separator 448 engages the radially inner surface 231 of the rocker shaft 230. The first separator and the second separator 348, 448 each divide the first chamber 341 and the second chamber 443 into (1) a first sub-chamber 332, 432 extending between a first sub-chamber axial end 334, 434 and the respective separator 348, 448, and (2) a second sub-chamber 338, 438 extending between a second sub-chamber axial end 336, 436 and the respective separator 348, 448, the first separator 348 and the second separator 448 each including an orifice 350, 450 defined between the first sub-chamber 332, 432 and the second sub-chamber 338, 438 providing fluid connection between the first sub-chamber 332, 432 and the second sub-chamber 338, 438. A first sub-chamber end cap 340 is fixed in the rocker shaft 230 to define the first sub-chamber axial end 334, and a second sub-chamber end cap 442 is fixed in the rocker shaft 230 to define the second sub-chamber axial end 436. Each of the hydraulic lash adjuster feed channels 322, 422 are in fluid communication with a respective one of the first sub-chambers 332, 432, and each of the switch channels 326, 426 is in fluid communication with a respective one of the second sub-chambers 338, 438. First and second rocker arm assemblies 360, 460 are arranged on the rocker shaft 230 and each include a hydraulic lash adjuster 370, 470 connected to a first intake port 374, 474 and a locking assembly 380, 480 connected to a second intake port 378, 478. The first sub-chambers 332, 432 each include a first actuator port 372, 472 in fluid connection with the first intake port 374, 474 for the hydraulic lash adjuster 370, 470, and the second sub-chambers 338, 438 each include a second actuator port 376, 476 in fluid connection with the second intake port 378, 478 for the locking assembly 380, 480.

The embodiments shown in FIGS. 4 and 5 illustrate the control valves in a single position, however one of ordinary skill in the art would recognize that the control valves can be actuated to change positions as discussed above with respect to FIGS. 2 and 3. Although only two separators are shown in FIGS. 4 and 5, one of ordinary skill in the art would recognize from the present disclosure that more than two separators could be provided using the same design and configuration shown in FIGS. 4 and 5.

Figure 6:
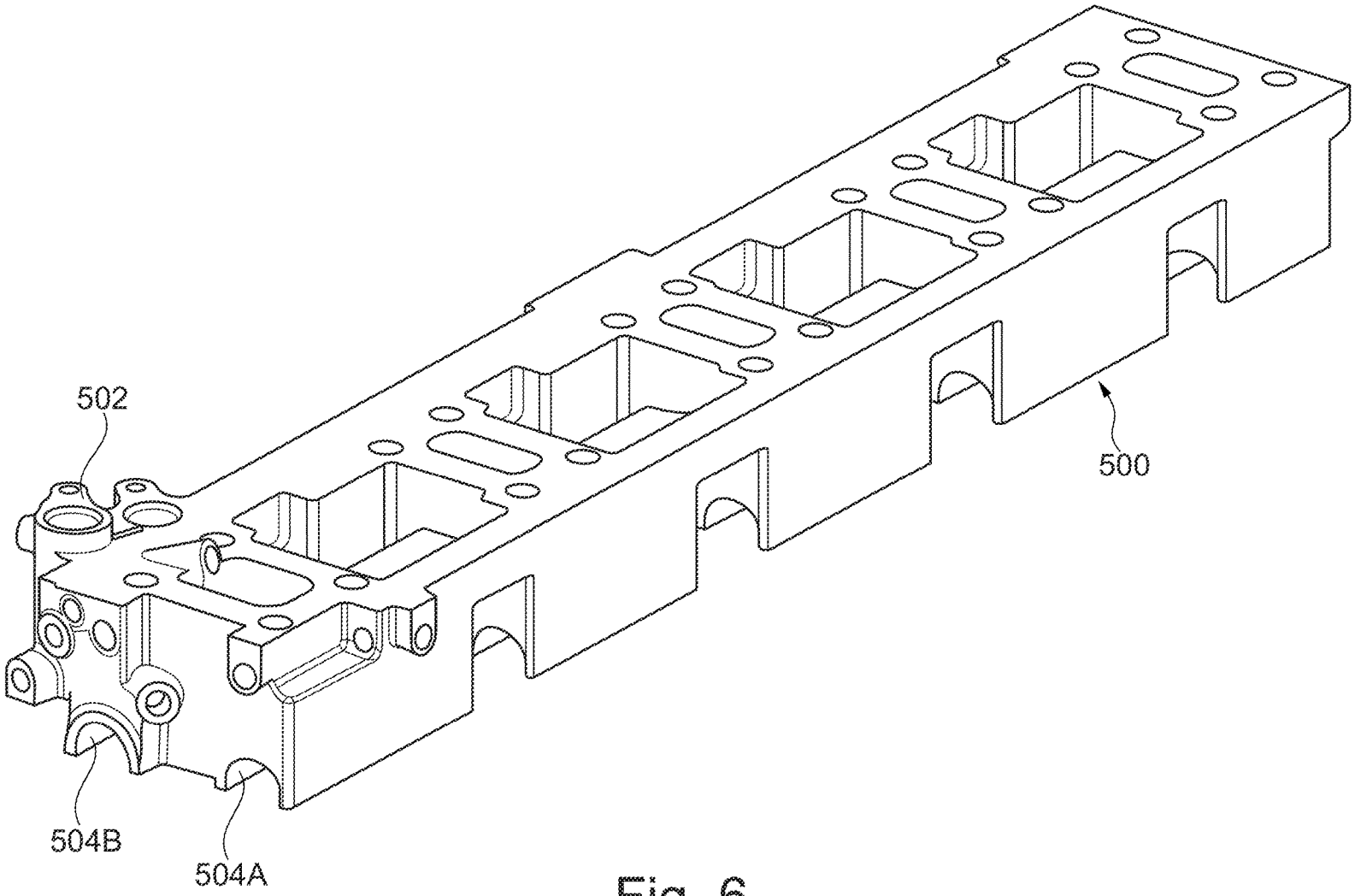
FIG. 6 is a perspective view of a carrier housing defining a hydraulic circuit for a switchable valve train assembly.

FIG. 6 illustrates one embodiment of a carrier housing 500 which defines a hydraulic fluid circuit and supports a plurality of rocker shafts. The carrier housing 500 includes a supply assembly support region 502, and rocker shaft support regions 504A, 504B. Galleries of the hydraulic fluid circuit within the carrier housing 500 are preferably formed by drilling, and are preferably capped by caps or plugs, such as ball plugs or the caps 40, 42 described above. The carrier housing 500 is preferably formed from aluminum.

Figure 7:
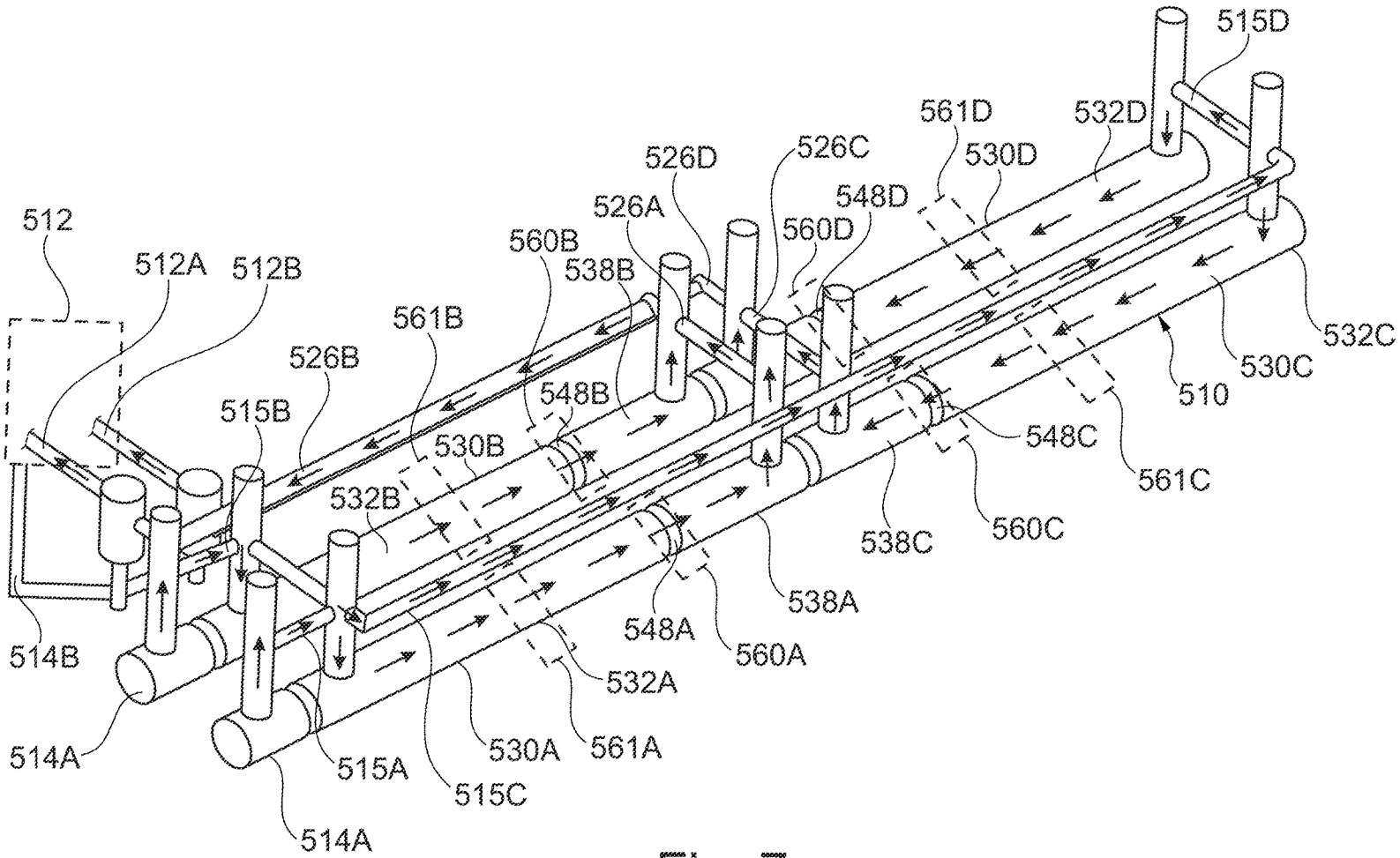
FIG. 7 is a perspective view of a switchable valve train assembly including four rocker shafts in a non-actuated state.
Figure 8:
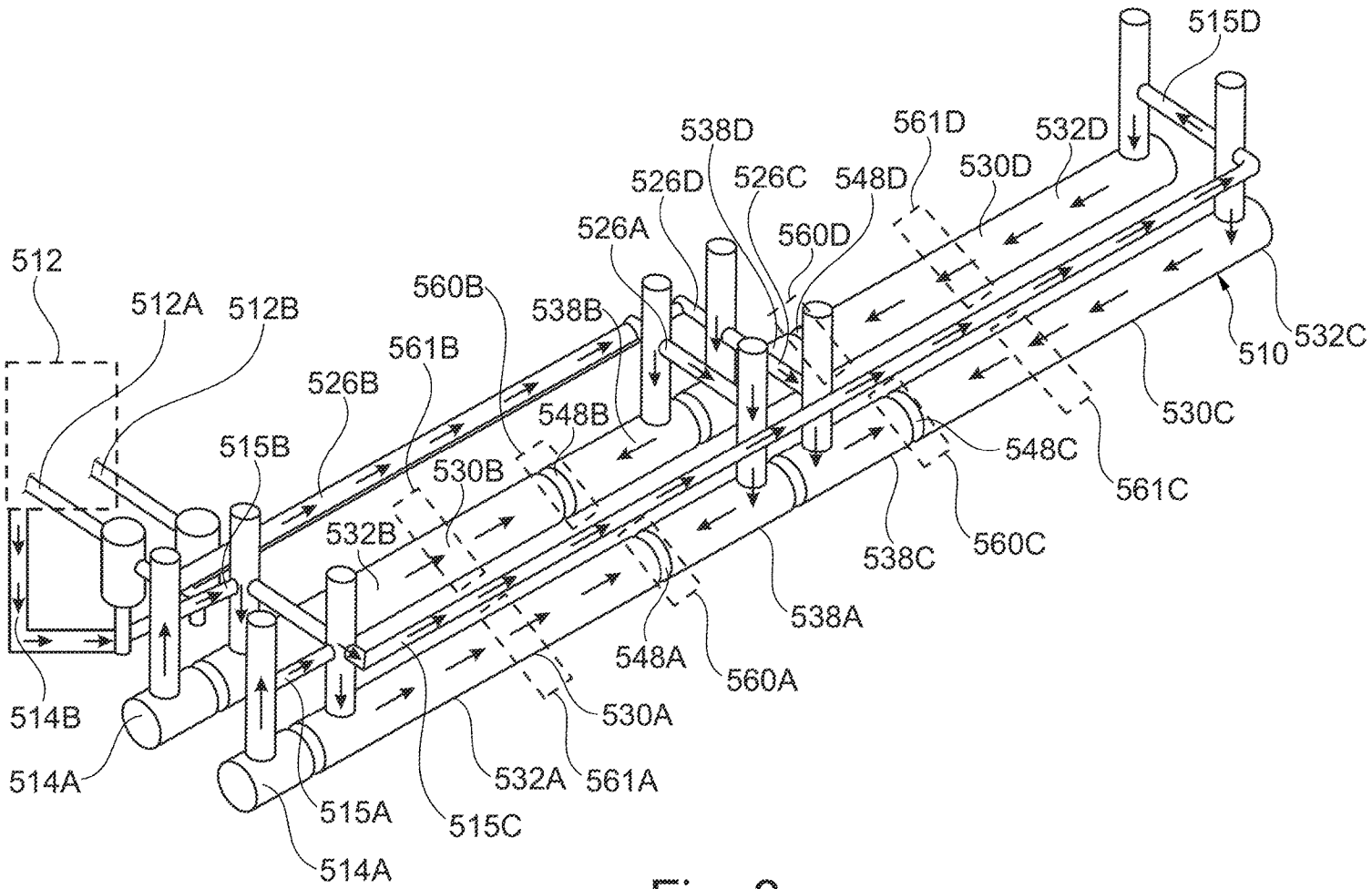
FIG. 8 is a perspective view of the switchable valve train assembly of FIG. 7 in an actuated state.

FIGS. 7 and 8 illustrate a switchable valve train assembly 510. The switchable valve train assembly 510 includes four rocker shafts 530A, 530B, 530C, 530D. The rocker shafts 530A, 530B, 530C, 530D are substantially identical to the rocker shaft 30 described in detail above. The rocker shafts 530A, 530B, 530C, 530D are supported on the carrier housing 500. As shown in FIG. 7, a first pair of the rocker shafts 530A, 530C are provided in series, and a second pair of the rocker shafts 530B, 530D are provided in series. Each of the rocker shafts 530A, 530B, 530C, 530D includes a separator 548A, 548B, 548C, 548D which divides the respective rocker shaft into a first chamber 532A, 532B, 532C, 532D and a second chamber 538A, 538B, 538C, 538D. The separators 548A, 548B, 548C, 548D are substantially identical to the separator 48 described above and perform the same functions of the separator 48 as described above.

Rocker arm assemblies 560A, 560B, 560C, 560D (shown in broken lines in FIGS. 7 and 8) are also provided on a respective one of the rocker shafts 530A, 530B, 530C, 530D. The rocker arm assemblies 560A, 560B, 560C, 560D are substantially identical to the rocker arm assembly 60 described above, and each rocker arm assembly 560A, 560B, 560C, 560D includes a hydraulic lash adjuster connected to a first intake port and a locking assembly connected to a second intake port.

A pressurized fluid source 514A is provided at a first end of rocker shafts 530A, 530B. In one embodiment, the pressurized fluid source 514A is provided in two journals. The pressurized fluid source 514A feeds pressurized hydraulic fluid into feed channels 515A, 515B which channel pressurized hydraulic fluid directly into the first chambers 532A, 532B of rocker shafts 530A, 530B. Another feed channel 515C extends beyond the rocker shafts 530A, 530B to provide pressurized hydraulic fluid from the pressurized fluid source 514A to rocker shaft 530C, and rocker shaft 530D via feed channel 515D. Supply assembly 512 provides a tank connection via tank channels 512A, 512B, and a pressurized fluid supply channel 514B. The supply assembly 512 is identical to the supply assembly 12 described in detail above. Switching channels 526A, 526B, 526C, 526D provide a fluid connection from a respective one of the second chambers 538A, 538B, 538C, 538D to the supply assembly 512.

FIG. 7 illustrates a non-actuated state for the locking assemblies of the rocker arm assemblies 560A, 560B, 560C, 560D in which the switching channels 526A, 526B, 526C, 526D feed hydraulic fluid to the tank (T) in the supply assembly 512 via tank channels 512A, 512B. The non-actuated state of FIG. 7 corresponds to the non-actuated state illustrated in FIG. 2 and described above. In the non-actuated state, orifices in the separators 548A, 548B, 548C, 548D direct hydraulic fluid from the first chambers 532A, 532B, 532C, 532D to a respective one of the second chambers 538A, 538B, 538C, 538D, where hydraulic fluid can flow back through the switch channels 526A, 526B, 526C, 526D to the tank (T) of the supply assembly 512. During this state, hydraulic fluid in the second chambers 538A, 538B, 538C, 538D is below a threshold pressure required to activate the locking assemblies of the rocker arm assemblies 560A, 560B, 560C, 560D. In one embodiment, this state corresponds to a locked mode of the locking assemblies. The hydraulic fluid flows through the second chambers 538A, 538B, 538C, 538D during this state, purging air pockets and air bubbles and providing a continuous flow of residual hydraulic fluid that improves switching times of the switchable valve train assembly 510.

FIG. 8 illustrates an actuated state for the locking assemblies of the rocker arm assemblies 560A, 560B, 560C, 560D. The actuated state of FIG. 8 corresponds to the actuated state of FIG. 3 described above. As shown in FIG. 8, the supply assembly 512 provides pressurized hydraulic fluid to the switching channels 526A, 526B, 526C, 526D, and the locking assemblies of the rocker arm assemblies 560A, 560B, 560C, 560D via the second chambers 538A, 538B, 538C, 538D of the rocker shafts 530A, 530B, 530C, 530D. The locking assemblies are actuated when this pressurized hydraulic fluid exceeds a threshold pressure required to activate the locking assemblies of the rocker arm assemblies 560A, 560B, 560C, 560D. In one embodiment, this state corresponds to an unlocked mode of the locking assemblies.

As shown in FIGS. 7 and 8, the switchable valve train assembly 510 includes four rocker arm assemblies 560A, 560B, 560C, 560D that are switchable. Four other standard rocker arm assemblies 561A, 561B, 561C, 561D can also be provided in the switchable valve train assembly 510. These standard rocker arm assemblies 561A, 561B, 561C, 561D are arranged outside of the switchable rocker arm assemblies 560A, 560B, 560C, 560D and are provided with a steady flow of pressurized hydraulic fluid from the pressurized fluid source 514A. One of ordinary skill in the art would recognize that additional standard rocker arms can be added to the rocker shafts 530A, 530B, 530C, 530D.

As described above with respect to FIGS. 2 and 3, the actuated and non-actuated states of FIGS. 7 and 8 can correspond to a selective opening/closing of certain cylinders. In another embodiment, the arrangement in FIGS. 7 and 8 could be used for a comprehensive cam profile switching strategy. Although FIG. 7 has been described as a locked mode and FIG. 8 has been described as an unlocked mode, one of ordinary skill in the art would recognize from the present disclosure that FIG. 7 can correspond to an unlocked mode and FIG. 8 can correspond to a locked mode.

Having thus described the present invention in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

LIST OF REFERENCES switchable valve train assembly 10
supply assembly 12
check valve 13
pressurized fluid source 14A, 14B
solenoid 16
control valve 18
hydraulic lash adjuster feed channel 22
switch channel 26
rocker shaft 30
radially inner surface 31
first chamber 32
central opening 33
first chamber axial end 34
second chamber axial end 36
second chamber 38
first chamber end cap 40
second chamber end cap 42
first sleeve 44
second sleeve 46
separator 48
orifice 50
radially outer surface 51
first recess 53
second recess 55
first axially extending flange 56
first passage 57
second axially extending flange 58
second passage 59
rocker arm assembly 60
first bolt 62
second bolt 64
radially inner surface 66
radially inner surface 68
hydraulic lash adjuster 70
first actuator port 72
first intake port 74
second actuator port 76
second intake port 78
locking assembly 80
switchable valve train assembly 100
rocker shaft 101
hollow center 104
camshaft end 106
valve end 108
plurality of rocker arm assemblies 110
carrier housing 500
supply assembly support region 502
rocker shaft support regions 504A, 504B
switchable valve train assembly 510
tank channels 512A, 512B
pressurized fluid source 514A
feed channels 515A, 515B, 515C, 515D
switching channels 526A, 526B, 526C, 526D
rocker shafts 530A, 530B, 530C, 530D
first chambers 532A, 532B, 532C, 532D
second chambers 538A, 538B, 538C, 538D
separators 548A, 548B, 548C, 548D
switchable rocker arm assemblies 560A, 560B, 560C, 560D
standard rocker arm assemblies 561A, 561B, 561C, 561D

What is claimed is:

1. A switchable valve train assembly comprising:

a carrier housing defining a hydraulic circuit, the carrier housing including rocker shaft support regions and a supply assembly support region;

a supply assembly connected to the supply assembly support region of the carrier housing including a pressurized fluid source for providing pressurized hydraulic fluid to the hydraulic circuit, and a solenoid and a control valve for selectively supplying the pressurized hydraulic fluid to the hydraulic circuit;

a hydraulic lash adjuster feed channel defined by the hydraulic circuit in fluid connection with the pressurized fluid source;

a switch channel defined by the hydraulic circuit in fluid connection with the control valve;

a plurality of rocker shafts supported on the rocker shaft support regions of the carrier housing, each one of the plurality of rocker shafts including a central space with one or more chambers defined by a radially inner surface;

a plurality of separators each secured in the central space of a respective one of the plurality of rocker shafts, and a radially outer surface of each one of the plurality of separators engages the radially inner surface of a respective one of the plurality of rocker shafts, each one of the plurality of separators divides the central space of each one of the plurality of rocker shafts into (1) a first chamber extending between a first chamber axial end and the separator, and (2) a second chamber extending between a second chamber axial end and the separator, the plurality of separators each include an orifice defined between the first chamber and the second chamber providing fluid connection between the first chamber and the second chamber, wherein the hydraulic lash adjuster feed channel is in fluid communication with the first chamber of each one of the plurality of rocker shafts via the hydraulic circuit;

wherein the switch channel is in fluid communication with the second chamber of each one of the plurality of rocker shafts via the hydraulic circuit; and a plurality of rocker arm assemblies each arranged on a respective one of the plurality of rocker shafts, each one of the plurality of rocker arm assemblies includes a hydraulic lash adjuster connected to a first intake port and a locking assembly connected to a second intake port, the first chamber of each one of the plurality of rocker shafts includes a first actuator port in fluid connection with a respective one of the first intake ports for the hydraulic lash adjuster, and the second chamber of each one of the plurality of rocker shafts includes a second actuator port in fluid connection with a respective one of the second intake ports for the locking assembly.

2. The switchable valve train assembly of claim 1, wherein a first pair of the plurality of the rocker shafts are arranged in series and axially spaced apart from each other, and a second pair of the plurality of rocker shafts are arranged in series and axially spaced apart from each other.

3. The switchable valve train assembly of claim 1, wherein the rocker shaft support regions of the carrier housing are each configured to support at least two rocker shafts.

4. The switchable valve train assembly of claim 1, wherein the plurality of rocker shafts includes four rocker shafts, the plurality of rocker arm assemblies includes four switchable rocker arm assemblies and four standard rocker arm assemblies, and the plurality of separators includes four separators.

5. The switchable valve train assembly of claim 1, wherein the carrier housing is formed from aluminum.

6. The switchable valve train assembly of claim 1, wherein galleries of the hydraulic circuit of the carrier housing are formed by drilling.

7. The switchable valve train assembly of claim 6, wherein axial ends of the hydraulic circuit are defined by caps pressed into the carrier housing.

8. The switchable valve train assembly of claim 1, wherein the plurality of separators are press-fit within a respective one of the plurality of rocker shafts.

9. The switchable valve train assembly of claim 1, wherein (1) the supply assembly has a first state in which the control valve closes a flow path from the pressurized fluid source to the switch channel, and the orifices of the plurality of separators allow pressurized hydraulic fluid to flow from the first chamber to the second chamber in each one of the plurality of rocker shafts, and the second chambers direct pressurized hydraulic fluid to the switch channel, and (2) the supply assembly has a second state in which the solenoid is activated and the control valve opens the flow path from the pressurized fluid source to the switch channel such that pressurized hydraulic fluid is provided via the switch channel to the locking assembly of each one of the plurality of rocker arm assemblies via the second chamber.

* * * * *